US008757243B2

(12) United States Patent
Bochiechio et al.

(10) Patent No.: US 8,757,243 B2
(45) Date of Patent: Jun. 24, 2014

(54) SHOT TUBE PLUNGER FOR A DIE CASTING SYSTEM

(71) Applicant: United Technologies Corporation, Hartford, CT (US)

(72) Inventors: Mario P. Bochiechio, Vernon, CT (US); Mark F. Bartholomew, Enfield, CT (US); Carl R. Verner, Windsor, CT (US); John F. Blondin, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/714,462

(22) Filed: Dec. 14, 2012

(65) Prior Publication Data

US 2013/0146266 A1 Jun. 13, 2013

Related U.S. Application Data

(63) Continuation of application No. 13/023,607, filed on Feb. 9, 2011, now Pat. No. 8,356,655.

(51) Int. Cl.
*B22D 17/04* (2006.01)
*B22D 41/005* (2006.01)

(52) U.S. Cl.
USPC ..... 164/312; 164/113; 164/348

(58) Field of Classification Search
USPC ..... 164/4.1, 113, 312, 348
See application file for complete search history.

(56) References Cited

U.S. PATENT DOCUMENTS

| | | | | |
|---|---|---|---|---|
| 4,036,113 | A | 7/1977 | Kunz | |
| 4,334,575 | A | 6/1982 | Miki et al. | |
| 4,583,579 | A | 4/1986 | Miki et al. | |
| 4,667,729 | A | 5/1987 | Zecman | |
| 4,779,665 | A | 10/1988 | Ouimet | |
| 4,842,039 | A * | 6/1989 | Kelm | 164/312 |
| 4,871,010 | A | 10/1989 | Dannoura | |
| 5,076,343 | A | 12/1991 | Sandercock | |
| 5,370,171 | A * | 12/1994 | Fields et al. | 164/312 |
| 5,860,468 | A | 1/1999 | Cook | |

(Continued)

FOREIGN PATENT DOCUMENTS

| | | | |
|---|---|---|---|
| DE | 3323328 | C1 | 5/1984 |
| EP | 0691166 | A1 | 1/1996 |
| JP | 10058108 | A | 3/1998 |
| WO | 0051764 | | 2/2000 |

OTHER PUBLICATIONS

Partial European Search Report for Application No. EP 12 15 4110 dated Jun. 21, 2012.

(Continued)

*Primary Examiner* — Keith Walker
*Assistant Examiner* — Steven Ha
(74) *Attorney, Agent, or Firm* — Carlson, Gaskey & Olds

(57) ABSTRACT

A method for controlling a temperature of a portion of a die casting system having a shot tube plunger, according to an exemplary aspect of the present disclosure includes, among other things, communicating a fluid through a fluid inlet of a fluid passageway of a thermal control scheme of the shot tube plunger. The fluid circulates through the fluid passageway of the thermal control scheme to selectively adjust a temperature of the shot tube plunger. The fluid is discharged through a fluid outlet of the fluid passageway.

19 Claims, 5 Drawing Sheets

(56) References Cited

U.S. PATENT DOCUMENTS

| | | | | |
|---|---|---|---|---|
| 5,947,183 | A | 9/1999 | Schneider et al. | |
| 6,378,597 | B1 | 4/2002 | Zecman | |
| 7,128,128 | B2 | 10/2006 | Kaba et al. | |
| 2006/0254747 | A1 | 11/2006 | Ishida et al. | |
| 2007/0137827 | A1 * | 6/2007 | Vogt et al. | 164/113 |
| 2007/0137830 | A1 | 6/2007 | Unal | |
| 2009/0139683 | A1 | 6/2009 | Muller et al. | |

OTHER PUBLICATIONS

Extended European Search Report for Application No. EP 12 15 4110 dated Sep. 28, 2012.

* cited by examiner

SHOT TUBE PLUNGER FOR A DIE CASTING SYSTEM

CROSS REFERENCE TO RELATED APPLICATIONS

This application is a divisional of U.S. patent application Ser. No. 13/023,607 which was filed Feb. 9, 2011 and issued on Jan. 22, 2013 as U.S. Pat. No. 8,356,655.

BACKGROUND

This disclosure relates generally to die casting systems, and more particularly to a shot tube plunger for a die casting system that includes a thermal control scheme for maintaining a temperature of the shot tube plunger.

Casting is a known technique used to yield near net-shaped components. For example, investment casting is often used in the gas turbine engine industry to manufacture near net-shaped components, such as blades and vanes having relatively complex geometries. A component is investment cast by pouring molten metal into a ceramic shell having a cavity in the shape of the component to be cast. Generally, the shape of the component to be produced is derived from a wax pattern or SLA pattern that defines the shape of the component. The investment casting process is capital intensive, requires significant manual labor and can be time intensive to produce the final component.

Die casting offers another known casting technique. Die casting involves injecting molten metal directly into a reusable die to yield a near net-shaped component. The components of the die casting system, including the shot tube and the shot tube plunger, are subjected to relatively high thermal loads and stresses during the die casting process.

SUMMARY

A method for controlling a temperature of a portion of a die casting system having a shot tube plunger, according to an exemplary aspect of the present disclosure includes, among other things, communicating a fluid through a fluid inlet of a fluid passageway of a thermal control scheme of the shot tube plunger. The fluid circulates through the fluid passageway of the thermal control scheme to selectively adjust a temperature of the shot tube plunger. The fluid is discharged through a fluid outlet of the fluid passageway.

In a further non-limiting embodiment of the foregoing method, the method includes monitoring a temperature of at least a portion of the shot tube plunger.

In a further non-limiting embodiment of either of the foregoing methods, the fluid passageway includes a coiled portion and the step of circulating the fluid includes circulating the fluid through the coiled portion of the fluid passageway.

In a further non-limiting embodiment of any of the foregoing methods, the coiled portion is disposed entirely inside of a tip portion of the shot tube plunger.

In a further non-limiting embodiment of any of the foregoing methods, the fluid heats the fluid passageway.

In a further non-limiting embodiment of any of the foregoing methods, the fluid cools the fluid passageway.

In a further non-limiting embodiment of any of the foregoing methods, discharging the fluid through a fluid outlet of the fluid passageway includes discharging the fluid through a shot rod of the die casting system.

In a further non-limiting embodiment of any of the foregoing methods, the fluid inlet and the fluid outlet extend in parallel in a direction of a longitudinal axis of the shot tube plunger and the thermal control scheme includes multiple coiled portions each having an inlet and an outlet. Each of the inlets of the multiple coiled portions are connected to the fluid inlet and each of the outlets of the multiple coiled portions are connected to the fluid outlet.

In a further non-limiting embodiment of any of the foregoing methods, the fluid outlet surrounds the fluid inlet.

In a further non-limiting embodiment of any of the foregoing methods, the fluid passageway includes a coiled portion that is cast or machined into the shot tube plunger.

In a further non-limiting embodiment of any of the foregoing methods, the fluid passageway includes a coiled portion that includes tubing sections separate from, and disposed internally to, the shot tube plunger.

A method for controlling a temperature of a shot tube plunger of a die casting system, according to another exemplary aspect of the present disclosure includes, among other things, circulating a fluid through a thermal control scheme disposed inside of the shot tube plunger to selectively adjust a temperature of the shot tube plunger. The shot tube plunger includes a plunger body and a separate tip portion attached only at a first face of the plunger body.

In a further non-limiting embodiment of the foregoing method, the fluid adds heat to the shot tube plunger.

In a further non-limiting embodiment of either of the foregoing methods, the fluid removes heat from the shot tube plunger.

In a further non-limiting embodiment of any of the foregoing methods, the first face faces toward a charge of material within the die casting system.

The various features and advantages of this disclosure will become apparent to those skilled in the art from the following detailed description. The drawings that accompany the detailed description can be briefly described as follows.

DETAILED DESCRIPTION

Figure 1:
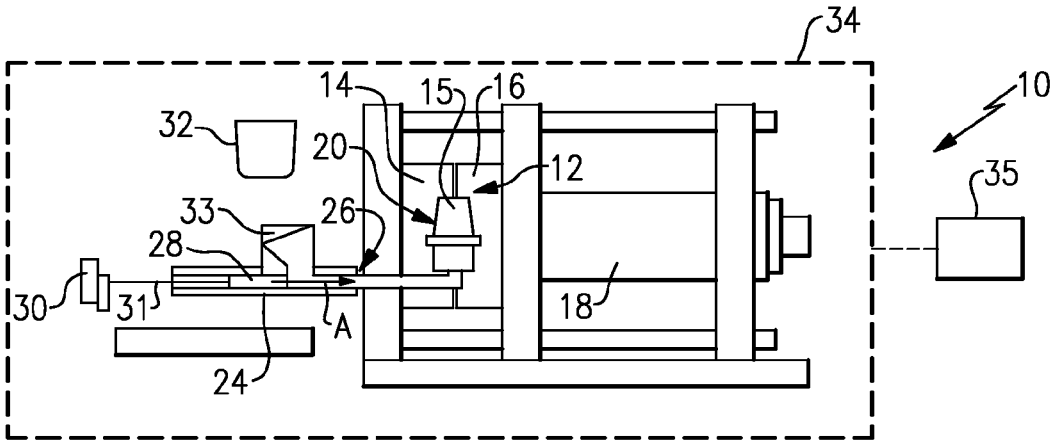
FIG. 1 illustrates an example die casting system.

FIG. 1 illustrates a die casting system 10 including a reusable die 12 having a plurality of die elements 14, 16 that function to cast a component 15. The component 15 could include aeronautical components, such as gas turbine engine blades or vanes, or non-aeronautical components. Although two die elements 14, 16 are depicted by FIG. 1, it should be understood that the die 12 could include more or fewer die elements, as well as other parts and other configurations.

The die 12 is assembled by positioning the die elements 14, 16 together and holding the die elements 14, 16 at a desired position via a mechanism 18. The mechanism 18 could include a clamping mechanism powered by a hydraulic system, pneumatic system, electromechanical system and/or other systems. The mechanism 18 also separates the die elements 14, 16 subsequent to casting.

The die elements 14, 16 include internal surfaces that cooperate to define a die cavity 20. A shot tube 24 is in fluid communication with the die cavity 20 via one or more ports 26 that extend into the die element 14, the die element 16 or both. A shut tube plunger 28 is received within the shot tube 24 and is moveable between a retracted and injected position (in the direction of arrow A) within the shot tube 24 by a mechanism 30. A shot rod 31 extends between the mechanism 30 and the shot tube plunger 28. The mechanism 30 could include a hydraulic assembly or other suitable system, including, but not limited to, pneumatic, electromechanical, hydraulic or any combination of the systems.

The shot tube 24 is positioned to receive a charge of material from a melting unit 32, such as a crucible, for example. The melting unit 32 may utilize any known technique for melting an ingot of metallic material to prepare molten metal for delivery to the shot tube 24. In this example, the charge of material is melted into molten metal by the melting unit 32 at a location that is separate from the shot tube 24 and the die 12. However, other melting configurations are contemplated as within the scope of this disclosure. The example melting unit 32 is positioned in relative close proximity to the die casting system 10 to reduce the transfer distance of the charge of material between the melting unit 32 and the die casting system 10.

Materials used to die cast a component 15 with the die casting system 10 include, but are not limited to, nickel-based super alloys, cobalt-based super alloys, titanium alloys, high temperature aluminum alloys, copper-based alloys, iron alloys, molybdenum, tungsten, niobium or other refractory metals. This disclosure is not limited to the disclosed alloys, and other high melting temperature materials may be utilized to die cast a component 15. As used in this disclosure, the term "high melting temperature material" is intended to include materials having a melting temperature of approximately 1500° F./815° C. and higher.

The charge of material is transferred from the melting unit 32 to the die casting system 10. For example, the charge of material may be poured into a pour hole 33 of the shot tube 24. A sufficient amount of molten metal is communicated to the shot tube 24 to fill the die cavity 20. The shot tube plunger 28 is actuated to inject the charge of material under pressure from the shot tube 24 into the die cavity 20 to cast a component 15. Although the casting of a single component 15 is depicted, the die casting system 10 could be configured to cast multiple components in a single shot.

Although not necessary, at least a portion of the die casting system 10 can be positioned within a vacuum chamber 34 that includes a vacuum source 35. A vacuum is applied in the vacuum chamber 34 via the vacuum source 35 to render a vacuum die casting process. The vacuum chamber 34 provides a non-reactive environment for the die casting system 10. The vacuum chamber 34 therefore reduces reaction, contamination or other conditions that could detrimentally affect the quality of the die cast component, such as excess porosity of the die cast component from exposure to air. In one example, the vacuum chamber 34 is maintained at a pressure between $5\times10^{-3}$ Torr (0.666 Pascal) and $1\times10^{-6}$ Torr (0.000133 Pascal), although other pressures are contemplated. The actual pressure of the vacuum chamber 34 will vary based on the type of component 15 or alloy being cast, among other conditions and factors. In the illustrated example, each of the melting unit 32, the shot tube 24 and the die 12 are positioned within the vacuum chamber 34 during the die casting process such that the melting, injecting and solidifying of the high melting temperature material are all performed under vacuum. In another example, the vacuum chamber 34 is backfilled with an inert gas, such as argon, for example.

The example die casting system 10 of FIG. 1 is illustrative only and could include more or fewer sections, parts and/or components. This disclosure extends to all forms of die casting, including but not limited to, horizontal, inclined or vertical die casting systems and other die casting configurations.

Figure 2A:
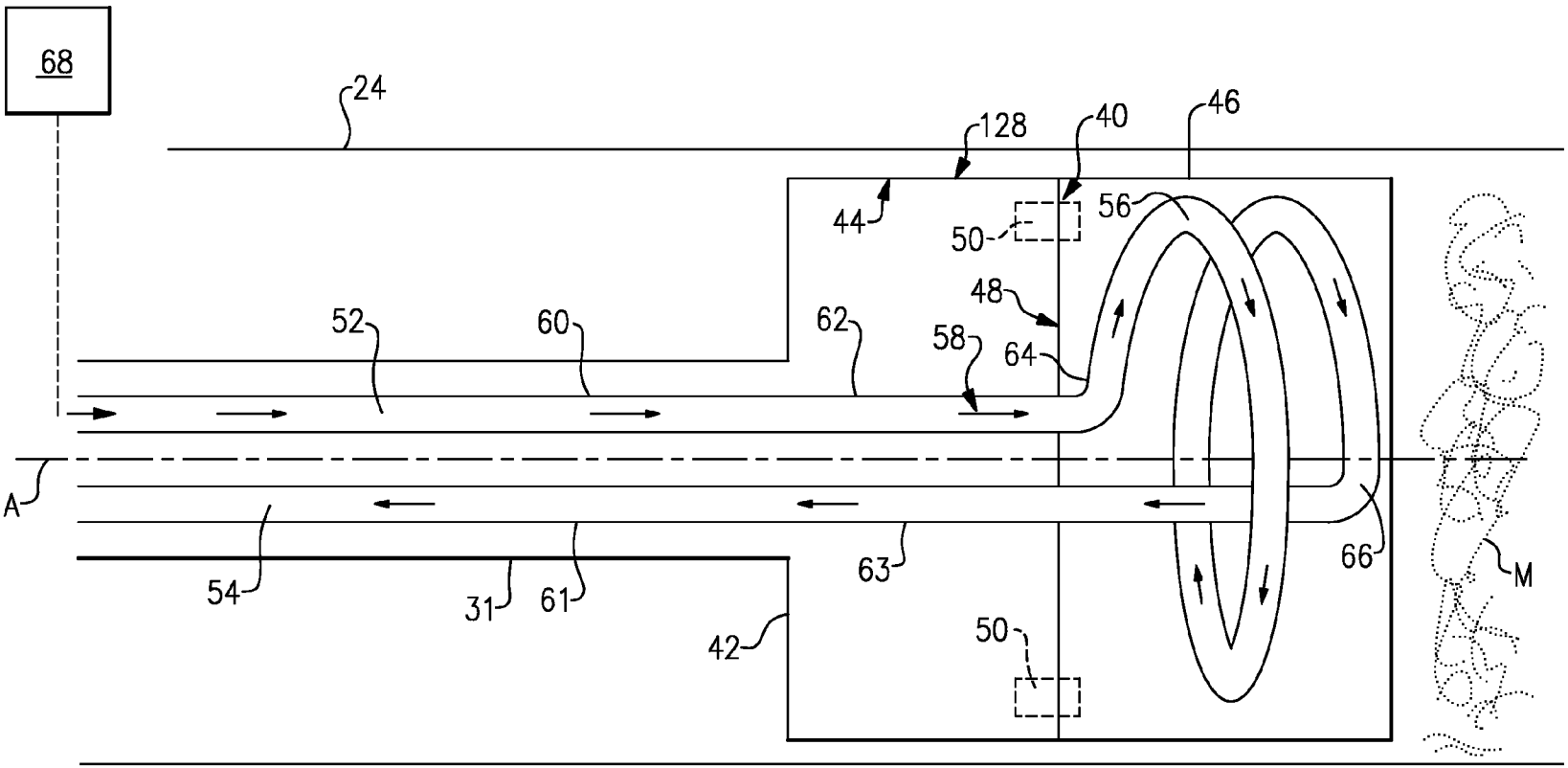
FIG. 2A illustrates an example shot tube plunger for use with a die casting system.

FIG. 2A illustrates an example shot tube plunger 128 for use with a die casting system, such as the die casting system 10. In this disclosure, like reference numerals signify like features, and reference numerals identified in multiples of 100 signify slightly modified features. Moreover, selected features of one example embodiment may be combined with selected features of other example embodiments within the scope of this disclosure. In addition, it should be understood that the shot tube plunger 128 is not shown to the scale it would be in practice. Rather, the shot tube plunger 128 is shown enlarged to better illustrate its features.

The shot tube plunger 128 includes a first face 40, a second face 42 and a plunger body 44 that extends between the first face 40 and the second face 42. The first face 40 faces toward a charge of material M within the shot tube 24, while the second face 42 faces toward and receives a portion of the shot rod 31. In this example, the plunger body 44 of the shot tube plunger 128 includes a cylindrical shape disposed about a longitudinal axis A of the shot tube plunger 128, although other shapes are contemplated as within the scope of this disclosure. The example shot tube plunger 128 could be made from copper, copper alloys or other suitable materials.

The shot tube plunger 128 also includes a tip portion 46 and a thermal control scheme 48 for controlling a temperature of the shot tube plunger 128 during the die casting of a component made from a high melting temperature material. In particular, the thermal control scheme 48 controls the temperature of the tip portion 46 of the shot tube plunger 128, which is the portion of the shot tube plunger 128 that is in direct contact with molten metal M during the die casting process. The tip portion 46 is attached to the first face 40 of the shot tube plunger 128 such that the tip portion 46 is positioned axially forward (in this case, toward the charge of material M) of the first face 40. In this example, the tip portion 46 is attached to the first face 40 of the shot tube plunger 128 with fasteners 50. Other attachment methods are contemplated as within the scope of this disclosure.

The thermal control scheme 48 includes a fluid inlet 52, a fluid outlet 54 and a coiled portion 56. The fluid inlet 52, the fluid outlet 54 and the coiled portion 56 define a fluid passageway 58 (shown schematically with arrows) of the thermal control scheme 48. The fluid passageway 58 receives a fluid, such as water, that is circulated through the thermal control scheme 48 to either add or remove heat from the shot tube plunger 128, and in particular, from the tip portion 46. In other words, the thermal control scheme 48 can either heat or cool the fluid passageway 58 and in turn adjust a temperature of the shot tube plunger 128.

The fluid passageway 58 of the thermal control scheme 48 is disposed internally to the shot rod 31 and the shot tube plunger 128. The thermal control scheme 48 can be cast or machined into the shot rod 31 and the shot tube plunger 128. For example, portions 60, 61 of the fluid inlet 52 and the fluid outlet 54, respectively, are disposed inside the shot rod 31. The shot tube plunger 128 also receives portions 62, 63 of the fluid inlet 52 and the fluid outlet 54, respectively. The coiled portion 56 is disposed within the tip portion 46 of the shot tube plunger 128, and is connected at an inlet 64 of the coiled portion 56 to receive fluid from the fluid inlet 52. The fluid is circulated through the coiled portion 56 and exits through an outlet 66 of the coiled portion 56. The fluid is then communicated through the fluid outlet 54 and exits the shot rod 31 for disposal or recirculation. A fluid source 68 provides a fluid, such as water, for circulation through the fluid passageway 58 of the thermal control scheme 48 to heat or cool the tip portion 46 of the shot tube plunger 128.

Alternatively, the thermal control scheme 48 can include multiple tubing sections that are separate from and positioned within the internal passageways formed in the shot rod 31 and the shot tube plunger 128. In this way, the thermal control scheme would provide a "closed-loop fluid passageway" in which the fluid that is circulated through the thermal control scheme 48 does not come into contact with the external surfaces of the shot rod 31 and shot tube plunger 128.

Figure 2B:
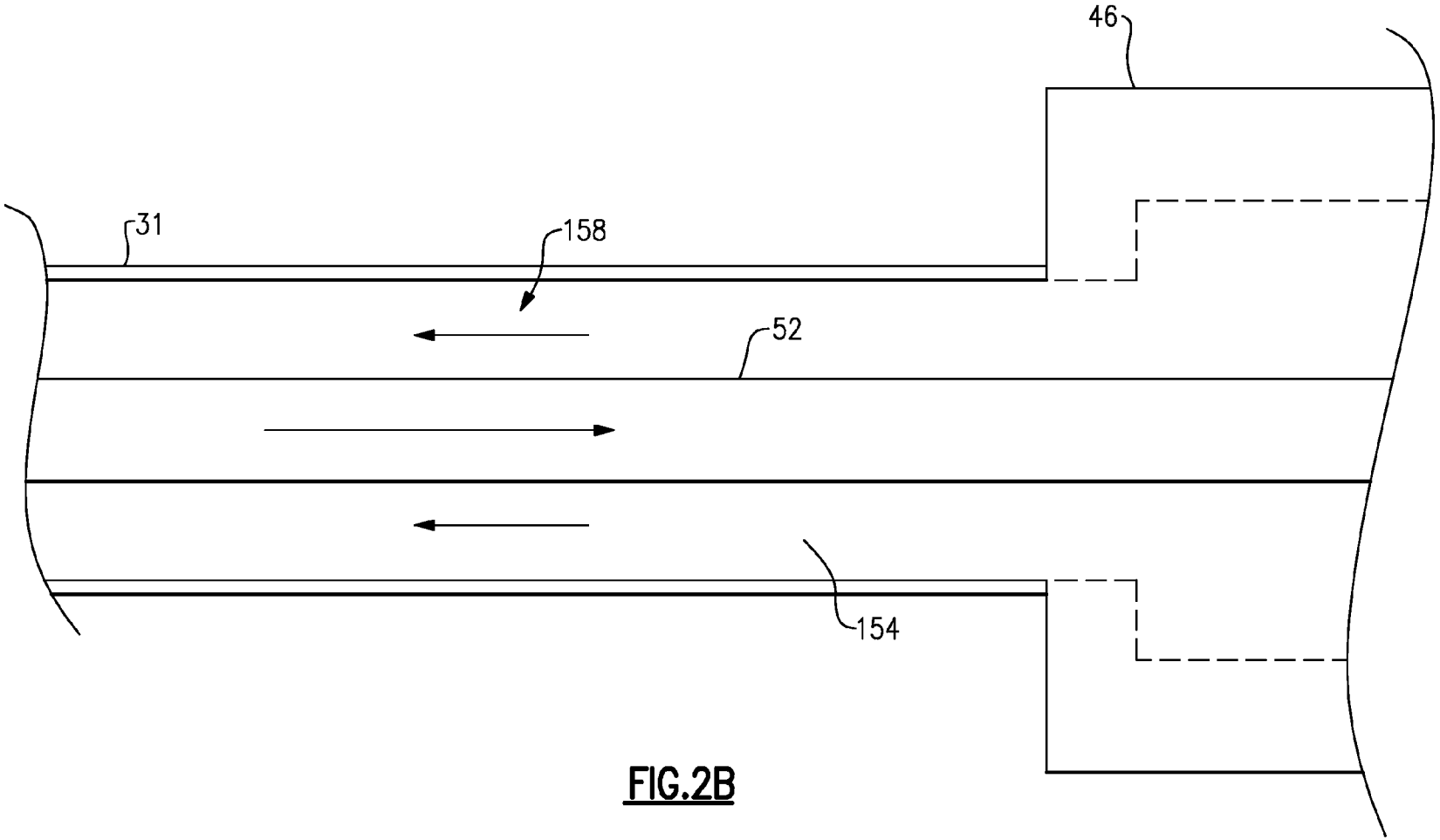
FIG. 2B illustrates a portion of an example shot tube plunger.

FIG. 2B illustrates a slightly modified fluid passageway 158. In this example, a fluid outlet 154 surrounds the fluid inlet 52. In other words, the fluid inlet 52 extends through the fluid outlet 154 to communicate the fluid into and out of the fluid passageway 158.

Figure 3:
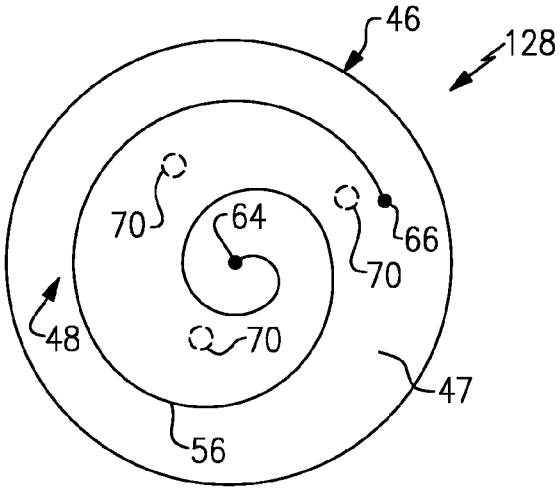
FIG. 3 illustrates a tip portion of an example shot tube plunger.

FIG. 3 illustrates an end view of the tip portion 46 of the shot tube plunger 128. In this example, the coiled portion 56 is helix-shaped. Other shapes are contemplated, including spiral shaped portions or other non-linear portions.

The thermal control scheme 48 could further include one or more thermocouples 70 embedded within a surface 47 of the tip portion 46. The thermocouples 70 may be embedded at any location of the tip portion 46. In this example, the thermocouple 70 is embedded at a location directly adjacent to the coiled portion 56 of the thermal control scheme 48. The embedded thermocouple 70 monitors a temperature of the tip portion 46 and indicates whether the temperature of the fluid circulated through the thermal control scheme 48 should be increased or decreased to either heat or cool the shot tube plunger 128 as desired.

The thermocouples 70 could include type K, type J or type T thermocouples. Other thermocouples are also contemplated as within the scope of this disclosure and could be chosen depending upon design specific parameters, including but not limited to, atmospheric temperatures and the alloy used to cast a component.

Figure 4A:
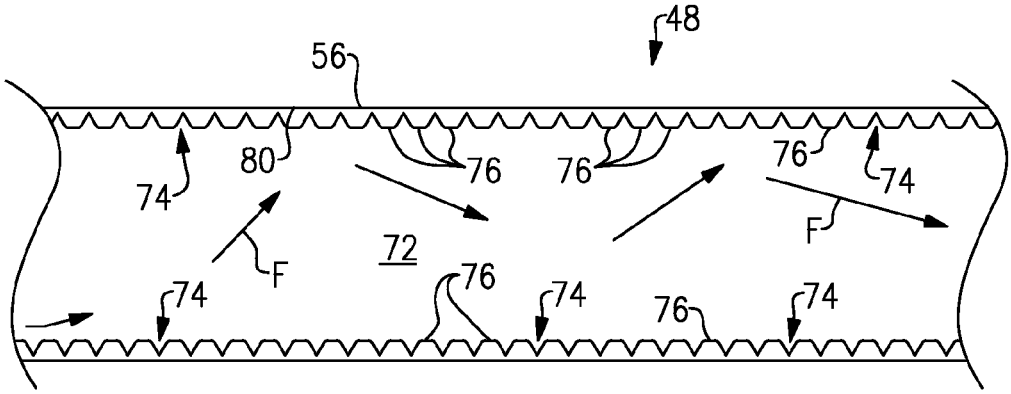
FIGS. 4A-4D illustrate features of an example shot tube plunger.

FIGS. 4A-4D depict other example features of the thermal control scheme 48. For example, the coiled portions 56 of the fluid passageway 58 can include internal passageways 72 having geometric features 74 designed to create a turbulent fluid flow F within the internal passageway 72 and increase the amount of heat transfer that occurs between the fluid and the shot tube plunger 128. As shown in FIG. 4A, for example, the geometric features 74 include knurled textures 76 that protrude from a wall 80 of the internal passageway.

Figure 4B:
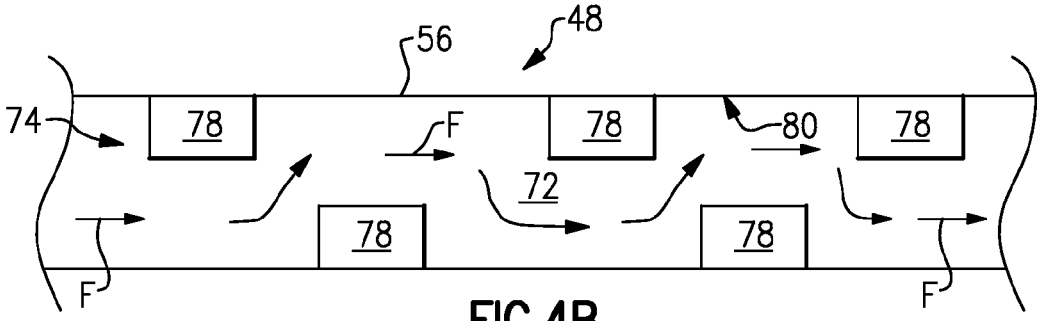
Figure 4C:
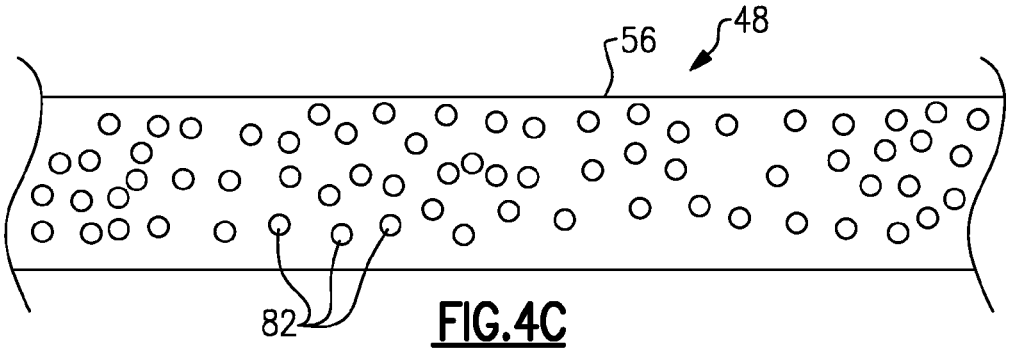
Figure 4D:
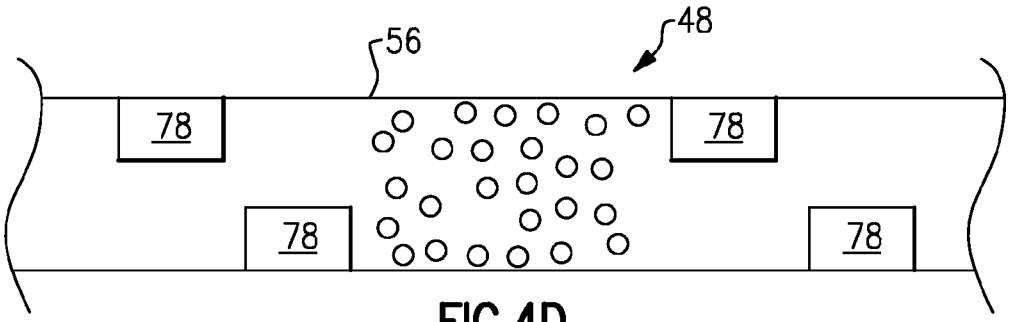

Alternatively, as shown in FIG. 4B, the geometric features 74 include alternating trip strips 78 that protrude from the wall 80 of the internal passageway 72. FIG. 4C illustrates that the geometric features 74 could include pedestals 82. In addition, as depicted in FIG. 4D, the geometric feature 74 of the internal passageway 72 could include a combination of features, such as pedestals 82 in combination with trip strips 78. Other geometric features and combinations of features for increasing heat transfer are contemplated as within the scope of this disclosure.

Figure 5:
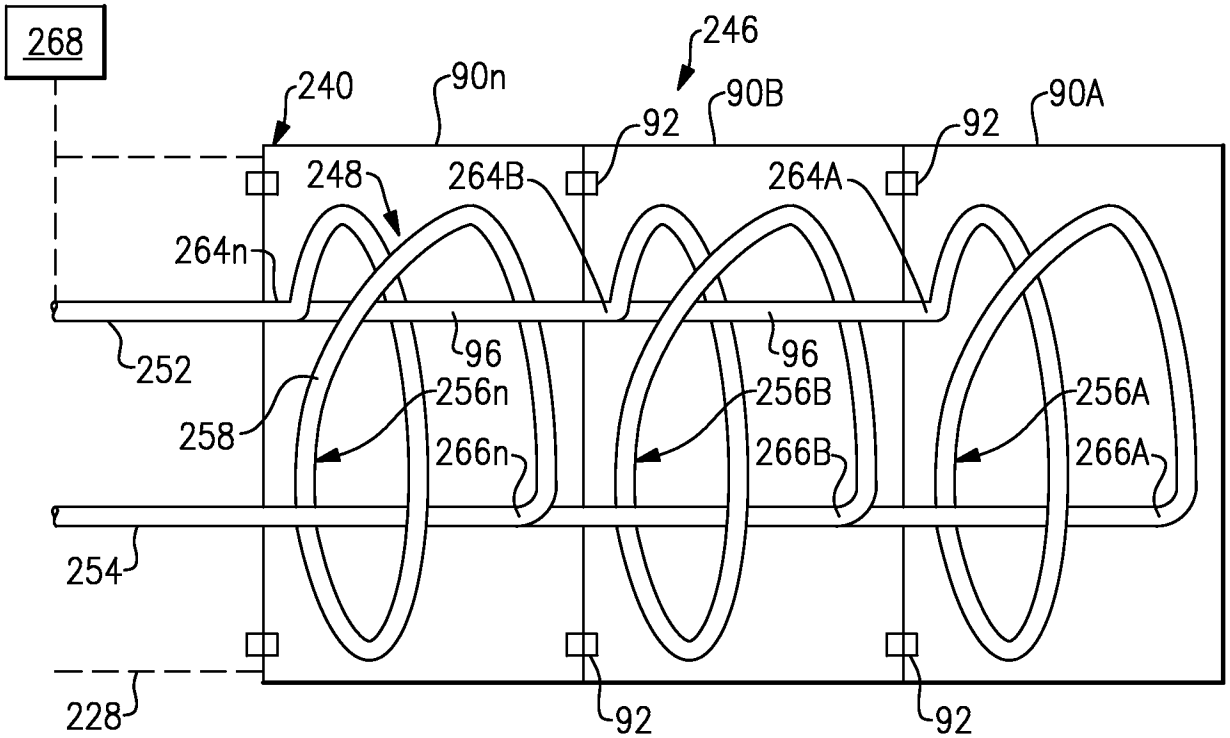
FIG. 5 illustrates another example shot tube plunger for use with a die casting system.

FIG. 5 illustrates another example shot tube plunger 228 for use with a die casting system. The shot tube plunger 228 is similar to the shot tube plunger 128 described above, except that the shot tube plunger 228 includes a modified tip portion 246. FIG. 5 is not to scale, but is shown enlarged to better detail the features of the tip portion 246.

In this example, the tip portion 246 includes a plurality of tip layers 90A-90*n* that are axially stacked upon one another (from the left to the right of FIG. 5) to provide a tip portion 246 having a desired thermal control scheme 248. In other words, the tip layers 90A-90*n* are coaxially disposed relative to the shot tube plunger 128. The actual number of tip layers 90 used will vary depending upon the cooling requirements of the shot tube plunger 128, among other factors. The stacked tip layers 90A-90*n* are attached relative to one another in a known manner, such as with a fastener 92. The tip portion 246 may then be attached to a first face 240 of the shot tube plunger 228.

The thermal control scheme 248 defines a fluid passageway 258. In one example, each tip layer 90A-90*n* includes a coiled portion 256A-256*n* of the fluid passageway 258. In this manner, a multiple layered thermal control scheme 248 is provided within the tip portion 246.

Each coiled portion 256A-256*n* includes an inlet 264A-264*n* and an outlet 266A-266*n* for receiving and discharging a fluid, respectively. The inlets 264A-264*n* of the coiled portions 256A-256*n* are connected to the inlet(s) of adjacent coiled portions via passages 96 such that fluid from a fluid source 268 is communicated through a fluid inlet 252 and is circulated through each coiled portion 256A-256*n* of the thermal control scheme 248. In other words, the inlet 264A of the coiled portion 256A is connected to the inlet 264B of the coiled portion 256B and so on. The outlets 266A-266*n* are in fluid communication with a fluid outlet 254 to discharge the circulated fluid.

Although not shown, the shot tube plunger 228 can also include other features such as those shown in FIG. 3 and FIG. 4. For example, the shot tube plunger 228 could include an embedded thermocouple or geometric features disposed within the internal passageways of the coiled portions 256.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A method for controlling a temperature of a portion of a die casting system having a shot tube plunger, comprising the steps of:

a) communicating a fluid through a fluid inlet of a fluid passageway of a thermal control scheme of the shot tube plunger;

b) circulating the fluid through the fluid passageway of the thermal control scheme to selectively adjust a temperature of the shot tube plunger, the fluid passageway includes multiple coiled portions each having an inlet and an outlet disposed internally to the shot tube plunger, wherein the fluid inlet and a fluid outlet extend in parallel in a direction of the longitudinal axis of the shot tube plunger, and each of the inlets of the multiple coiled portions are connected to the fluid inlet and each of the outlets of the multiple coiled portions are connected to the fluid outlet; and c) discharging the fluid through the fluid outlet of the fluid passageway.

2. The method as recited in claim 1, comprising the step of:

(d) monitoring a temperature of at least a portion of the shot tube plunger.

3. The method as recited in claim 1, wherein the step of circulating the fluid includes:

circulating the fluid through the multiple coiled portions of the fluid passageway.

4. The method as recited in claim 3, wherein each coiled portion of the multiple coiled portions is disposed entirely inside of a tip portion of the shot tube plunger.

5. The method as recited in claim 1, wherein the fluid heats the fluid passageway.

6. The method as recited in claim 1, wherein the fluid cools the fluid passageway.

7. The method as recited in claim 1, wherein said step c) includes discharging the fluid through a shot rod of the die casting system.

8. The method as recited in claim 1, wherein the fluid outlet surrounds the fluid inlet.

9. The method as recited in claim 1, wherein the multiple coiled portions are is cast or machined into the shot tube plunger.

10. The method as recited in claim 1, wherein the multiple coiled portions includes tubing sections separate from, and disposed internally to, the shot tube plunger.

11. A method for controlling a temperature of a shot tube plunger of a die casting system, comprising the step of:

circulating a fluid through a thermal control scheme having a fluid passageway that includes at least one coiled portion disposed inside of the shot tube plunger to selectively adjust a temperature of the shot tube plunger, wherein the shot tube plunger includes a plunger body and a separate tip portion attached only at a first face of the plunger body.

12. The method as recited in claim 11, wherein the fluid adds heat to the shot tube plunger.

13. The method as recited in claim 11, wherein the fluid removes heat from the shot tube plunger.

14. The method as recited in claim 11, wherein the first face faces toward a charge of material within the die casting system.

15. The method as recited in claim 1, wherein the at least one coiled portion includes an internal passageway having a plurality of geometric features that create a turbulent flow of the fluid.

16. The method as recited in claim 15, wherein the plurality of geometric features include at least one of trip strips, knurled textures, and/or pedestals.

17. The method as recited in claim 1, wherein the shot tube plunger is comprised of a plurality of tip layers coaxially disposed to define the fluid passageway.

18. The method as recited in claim 1, wherein the fluid outlet is circumscribed by the at least one coiled portion.

19. A method for controlling a temperature of a portion of a die casting system having a shot tube plunger, comprising the steps of:

(a) communicating a fluid through a fluid inlet of a fluid passageway of a thermal control scheme of the shot tube plunger;

(b) circulating the fluid through the fluid passageway of the thermal control scheme to selectively adjust a temperature of the shot tube plunger; and (c) discharging the fluid through a fluid outlet of the fluid passageway, wherein the fluid inlet and the fluid outlet extend in parallel in a direction of a longitudinal axis of the shot tube plunger and the thermal control scheme includes multiple coiled portions each having an inlet and an outlet, and each of the inlets of the multiple coiled portions are connected to the fluid inlet and each of the outlets of the multiple coiled portions are connected to the fluid outlet.

* * * * *

UNITED STATES PATENT AND TRADEMARK OFFICE

CERTIFICATE OF CORRECTION

PATENT NO. : 8,757,243 B2
APPLICATION NO. : 13/714462
DATED : June 24, 2014
INVENTOR(S) : Mario P. Bochiechio et al.

It is certified that error appears in the above-identified patent and that said Letters Patent is hereby corrected as shown below:

IN THE CLAIMS:

In claim 9, column 7, line 13; delete "is"

Signed and Sealed this
Sixteenth Day of September, 2014

Michelle K. Lee

Michelle K. Lee
*Deputy Director of the United States Patent and Trademark Office*